US007125342B2

(12) United States Patent
Port et al.

(10) Patent No.: US 7,125,342 B2
(45) Date of Patent: Oct. 24, 2006

(54) PUTTING TRAINING AID AND CALIBRATION DEVICE

(76) Inventors: Richard M. Port, 204 Northampton La., Lincolnshire, IL (US) 60069; John M. Andrews, 142 Cristfield Dr., Grayslake, IL (US) 60030

( * ) Notice: Subject to any disclaimer, the term of this patent is extended or adjusted under 35 U.S.C. 154(b) by 0 days.

(21) Appl. No.: 11/113,942

(22) Filed: Apr. 25, 2005

(65) Prior Publication Data

US 2005/0197200 A1 Sep. 8, 2005

Related U.S. Application Data

(60) Division of application No. 10/838,016, filed on May 3, 2004, now Pat. No. 6,921,341, which is a continuation-in-part of application No. 10/160,423, filed on May 31, 2002, now Pat. No. 6,729,968.

(51) Int. Cl.
*A63B 69/36* (2006.01)

(52) U.S. Cl. ..... 473/261; 473/238; 473/257

(58) Field of Classification Search ..... 473/238, 473/251–254, 257–262
See application file for complete search history.

(56) References Cited

U.S. PATENT DOCUMENTS

| | | | | |
|---|---|---|---|---|
| 1,943,066 | A | 1/1934 | Ford | |
| 3,214,169 | A | 10/1965 | Rupnow | |
| 3,953,035 | A | 4/1976 | Beckisk | |
| 4,468,034 | A | 8/1984 | Duclos | |
| 4,620,708 | A | 11/1986 | Meyer et al. | |
| 4,736,952 | A | 4/1988 | Taft et al. | |
| 4,852,881 | A | 8/1989 | Bellagamba et al. | |
| 4,869,510 | A | 9/1989 | Battersby | |
| 4,900,030 | A * | 2/1990 | Houtz | 473/258 |
| 5,332,211 | A * | 7/1994 | Rife et al. | 473/258 |
| 5,423,548 | A | 6/1995 | Bricker | |
| 5,433,445 | A | 7/1995 | Melancon | |
| 5,480,151 | A * | 1/1996 | Adams | 473/238 |
| 5,482,284 | A * | 1/1996 | Vandever | 473/218 |
| 5,586,945 | A | 12/1996 | Vonderhaar | |
| 5,595,543 | A | 1/1997 | Wolk | |
| 5,769,732 | A | 6/1998 | O'Neal | |
| 5,997,410 | A * | 12/1999 | Nothdurft | 473/258 |
| 6,159,106 | A | 12/2000 | Adams | |
| 6,623,372 | B1 | 9/2003 | Beebe et al. | |
| 6,729,968 | B1 * | 5/2004 | Port et al. | 473/261 |
| 6,921,341 | B1 | 7/2005 | Port et al. | |

* cited by examiner

*Primary Examiner*—Nini F. Legesse
(74) *Attorney, Agent, or Firm*—Jansson, Shupe, Munger & Antaramian, Ltd.

(57) ABSTRACT

A putting training aid and putter calibration device for use on a putting surface is disclosed which includes a horizontal calibrated bar with a linear centered scale and a parallel calibration block having an orthogonal face and set on the practice putting surface below and offset from the horizontal calibrated bar. Also provided is a linear scale decal which is applied to a putter shaft. The device is designed to align the putter head to proper lie and neutral loft so that the face is square to the intended target line and to teach the golfer the proper grip, stance, alignment of the golfer, alignment of the club and proper putting stroke.

16 Claims, 4 Drawing Sheets

PUTTING TRAINING AID AND CALIBRATION DEVICE

RELATED APPLICATIONS

This application is a Division of U.S. patent application Ser. No. 10/838,016, filed May 3, 2004, now U.S. Pat. No. 6,921,341 B2, issued Jul. 26, 2005, which is a Continuation-In-Part of U.S. patent application Ser. No. 10/160,423, filed May 31, 2002, now U.S. Pat. No. 6,729,968 B2, issued May 4, 2004. The entire contents of the above applications are incorporated herein by reference in entirety.

BACKGROUND OF THE INVENTION

This invention relates generally to golf training aids, and more particularly to training aids dealing with that part of the golf game referred to as putting. Training aids are commonly used in the game of golf to assist the golfer to improve a particular aspect of the golfer's game. These can be used for self improvement or with the assistance of a professional golf instructor. The present invention is intended to improve the putting portion of the golf game and can also be used to assist in the selection of the putter best suitable for a given golfer's style of putting stroke.

Prior putting aids have failed to assist the golfer in proper club selection. Additionally, past training aids have used a subjective approach to correction of the stroke without using or establishing objective criteria. This invention can objectively calibrate the loft of the putter face and the lie angle of the putter. The loft of the putter face is defined as the angle between the club face and the vertical plane. A neutral loft would generally have neither a positive nor a negative loft. The lie angle is defined as the angle between the club shaft center line and the horizontal plane. This invention is intended to provide the golfer with objective measurement criteria, which, when incorporated into the golfer's game through adjustment of the loft, horizontal and vertical positioning of the putter, the golfer should achieve more consistent putting performance. The invention, when used in accordance with its instructions, is intended to provide an aid for the development of a reproducible putting stroke from an objective repeatable set up position that is consistently on line with the intended target. The training aid will afford the user the opportunity to achieve sustainable positive putting results.

SUMMARY OF THE INVENTION

In order to consistently and accurately putt a golf ball on a putting surface, the putter's face should be square to the intended target and the putter's sole should be parallel to the putting surface.

If the sole is not parallel to the surface, the toe or the heel of the putter could drag on the putting surface. If the toe drags the putter can pivot on the toe and tend to "push" the ball away from the golfer. On the other hand if the heel drags, the putter can pivot on the heel and tend to "pull" the ball toward the golfer. In either case the result is a putter face which is vertically out of square with the intended target line.

The putter face loft also affects the golfer's ability to keep the golf ball on an intended golf ball path. For instance, a positive putter face loft at contact with the golf ball may lift the golf ball off the putting surface. For some golfers, lifting the golf ball in this manner may cause the golf ball to deviate from the golf ball's intended path. For other golfers, a controlled amount of lift may be useful to impart desired topspin to the golf ball, thereby making it easier to keep the golf ball on the intended path. A negative putter face loft at contact with the golf ball may urge the golf ball down into the putting surface resulting in deviation from the intended path. A neutral putter face loft which has neither a positive nor negative angle should provide the golfer with an opportunity to better square the putter face to the ball at contact with the golf ball and to direct the golf ball along the intended golf ball path. As can be appreciated, an objective measure of the angle comprising the putter face loft represents information of great use and value to the golfer. Such information can be important while golfing and when selecting a putter for purchase as commercially-available putters may each have a unique putter face loft.

The present invention allows the golfer to establish a neutral position for the putter at contact with the ball with respect to both loft and lie. In this manner, the golfer can determine if a particular putter, with its loft and lie, comfortably suits the golfer's physique, putting stance and putting style.

The training and the calibration aid embodying the present invention includes a frame supporting a horizontal calibration bar. The calibration bar has a calibration scale applied to the bar on a decal or similar application. The calibration scale has a zero point and may be marked with position notations suitable for the individual golfer. A calibration block, having an orthogonal face is positioned below and offset from the calibration bar on the putting surface.

In calibration mode operation, the putter is balanced against the calibration bar, with the sole of the putter head aligned to the putting surface. The putter face may then be leaned against the orthogonal face of the calibration block to square the face on the intended target line. The resulting position of the putting handle may be then marked on the calibration decal on the horizontal calibration band on a similar calibration decal applied to the putter's shaft. These markings determine a repeatable setup position for the putter with close to zero loft. In the practice mode, the calibration block is removed and the putter is placed so that the calibration marks are aligned for the optimum setup position. Such setup position is based on objective criterion and is repeatable for subsequent putter strokes. The golfer then grips the putter and practices a putting stroke guided by the horizontal calibration bar so that the golfer becomes comfortable with the repeatable setup position and then can develop a correct, repeatable putting stroke from that objectively-determined setup position.

It is an object of the present invention to provide a golf training aid to improve putting performance through proper horizontal alignment of the putter and providing the user with an objective measurement indicator to maintain horizontal alignment.

It is a further object of the present invention to provide a golf training aid to improve putting performance through proper vertical alignment of the putter shaft and providing the user with an objective measurement indicator to maintain vertical alignment.

It is another object of the present invention to provide a golf training aid to improve putting performance through proper alignment of the putter club face to the target line and providing the user with an objective measurement indicator to maintain putter club face alignment.

It is yet another object of the invention to provide a golf training aid to improve putting performance through the use of a horizontally supported guide rail above and offset from the intended target path to which the putter remains in contact throughout the practice putting stroke.

DETAILED DESCRIPTION OF PREFERRED EMBODIMENTS

Figure 1:
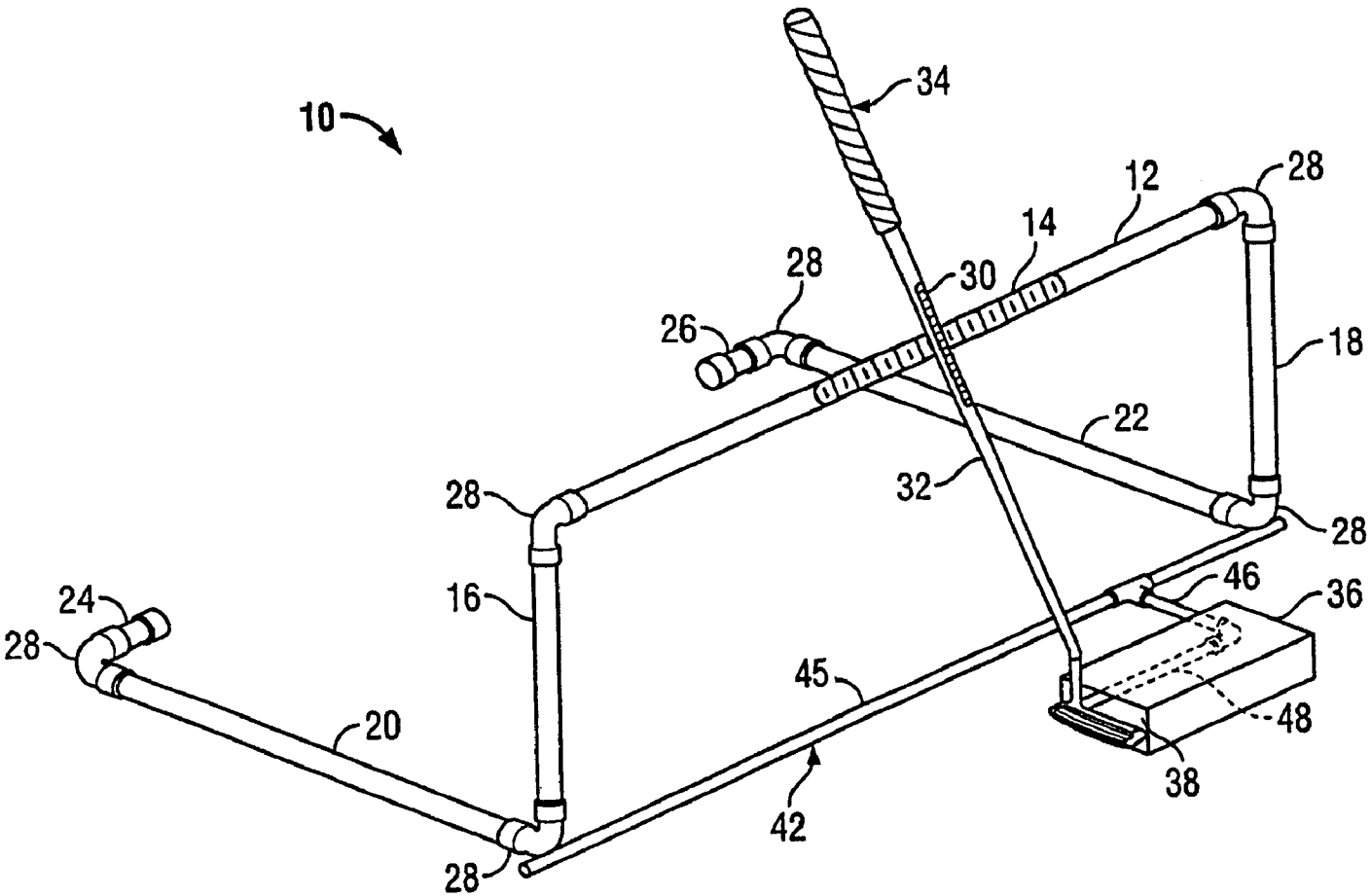
FIG. 1 is a general perspective view of a training aid embodying the present invention including a putter face calibration block and an exemplary putter.

Referring now to the drawings, and particularly to FIG. 1 thereof, there is shown the preferred embodiment of the training aid 10 according to the present invention, which includes the horizontal crossbar 12 with calibration scale 14, vertical support bars 16 and 18, horizontal legs 20 and 22 and stabilizing extensions 24 and 26. The horizontal crossbar, vertical support bars, horizontal legs and stabilizing extensions are attached to each other with elbow connectors 28.

Also shown in FIG. 1 is calibration block 36 which includes calibration face 38 which is orthogonal to the puffing surface 40 when block 36 is placed thereon. Calibration block 36 is fixed in position relative to horizontal crossbar 12 by spacer jig assembly 42 which includes spacer arm 45, which in calibration mode is designed to abut the bases of legs 16 and 18. Spacer extension 46 and spacer bar 48 (shown in phantom) gauges the proper offset distance from the crossbar to the calibration block on the puffing surface and ensures that the calibration block is placed parallel to the crossbar so the putter face is not open or closed during the loft calibration process. Located on the putting surface, is ball spot 44 which indicates the position, beneath the calibration block, of the center resting point of an imaginary golf ball whose trailing edge is tangential with the orthogonal calibration face of the calibration block. In other words, the point at which a golf ball would be placed to be in contact with the face of the putter when it is in position to be aligned with the orthogonal face of the calibration block.

The invention in its preferred embodiment has a horizontal crossbar 12 measuring 32 inches in length supported by two vertical support bars 16 and 18, each measuring 18 inches in height. In one embodiment, all of the tubular components of the calibration frame are lengths of PVC pipe. Calibration decal 14 has a mark indicating the center point of the calibration bar and indicating regular demarcations on either side of the center point. A second linear calibration decal 30 is affixed to the shaft 32 of the putter 34.

The balanced stand-alone position is defined as the position of the putter when it lays vertically against the device crossbar with the proper lie angle and the head of the putter perpendicular to the crossbar. This position is achieved by placing the shaft of the putter on the large center arrow marked on the crossbar so that it is balanced and will stand alone.

The head of the putter should be perpendicular to the crossbar so that the face of the putter is not open or closed in relation to the putting plane and target line. Each putter has a unique lie angle. The lie angle is defined as the angle of the shaft in relation to the sole or bottom of the putter head. Such sole or bottom of the putter would include points very generally representing a horizontal plane located therealong. In order to have the proper lie angle, the sole of the putter head must have maximum contact with the putting surface while the shaft of the putter is in contact with the crossbar of the device.

Figure 2:
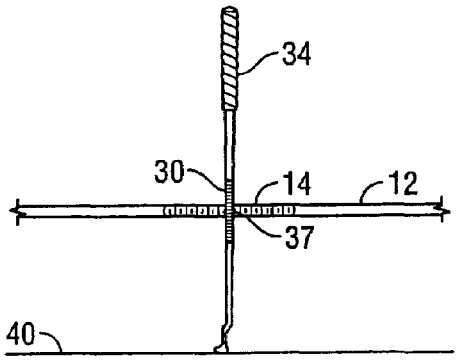
FIG. 2 is a front plan view of the putter shaft perpendicular to the horizontal calibration bar with the sole of the putter resting on the putting surface.
Figure 3:
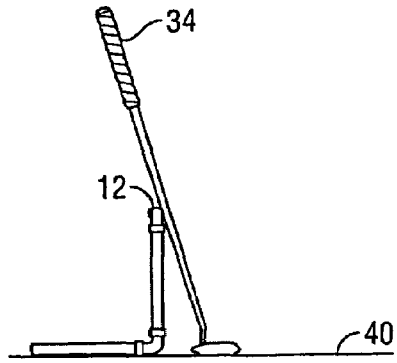
FIG. 3 is a side view of the putter shaft depicting the angle of the shaft relative to the bar when the sole of the putter is in maximum contact with the putting surface.

FIG. 2. illustrates the balanced stand-alone position of the putter from a front view, with the putter aligned at the center mark of the calibration scale 14 and the sole of the putter resting in maximum contact with the horizontal putting surface 40, as more readily seen in FIG. 3. For putters having a flat sole, the contact will extend along the length of the sole. When the putter is set at the balanced stand-alone position a mark 37 is placed on calibration decal 30 on shaft 32 of the putter 34 to correspond to the point of contact of the putter shaft to crossbar 12.

Putters can have different lofts like any other golf club. The putter should be calibrated so that the golfer's hands can be placed in a repeatable, objectively-determined position to insure that the ball is struck with a flat putter surface and close to zero loft. Once the player has mastered striking the ball with a flat putter surface, the hand position can be changed purposely to alter the loft of the putter if desired. The following steps are used to calibrate the putter face for a right handed golf club:

1. Placing the loft-calibrating block so that the face of the block is flush with bottom of the face of the putter in the stand-alone balanced position. If the putter has loft there will be visible space between the top of the face of the putter and the top of the block.

2. Holding the calibrating block with the right hand, gently slide the shaft of the putter with the left hand to the right (i.e., forward) along the crossbar until the entire putter face is flush with the loft calibration block. Persons of skill in the art will appreciate that the calibration process for a left handed golf club is identical except that the block position would be reversed and the club would be moved forward to the left along the crossbar.

Figure 4:
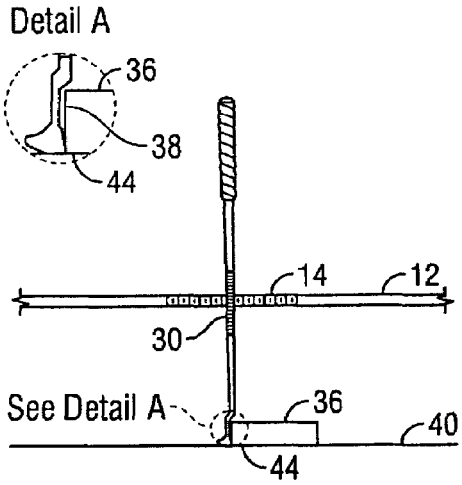
FIG. 4 is a front view of the putter shaft resting on the horizontal calibration bar with the sole of the putter resting on the putting surface with the putter's loft angle presenting a gap to the face of the calibration block.
Figure 5:
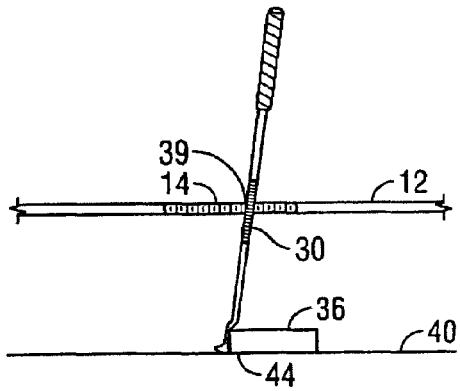
FIG. 5 is a front view of the putter shaft resting on the horizontal calibration bar with the sole of the putter resting on the putting surface with the putter leaned into the calibration block and the face of the putter flush with the face of the calibration block.

Initially, with the putter shaft placed at the zero point on the calibration scale 14, the face of the putter is not flush to the calibration block (FIG. 4 Detail A). As the putter shaft is aligned so that the club face of the putter is flush with the vertical face of the calibration block, the shaft of the putter is moved to either right or left of the center point on the calibration bar. This process results in the putter face being in a position having about zero degrees of loft (i.e., neutral). This is generally the preferred hitting position. The realigned calibration point is an objective measurement, which can be repeated during golf play to achieve optimal putting results. When the putter is set up in the optimum position shown in FIG. 5, the golfer can determine if the particular putter is comfortable in the golfer's hands. This is governed, in large part, by the loft and lie of the putter, on the one hand, and the physique, stance and putting style of the golfer, on the other. When the putter is set at the zero degree position a mark 39 is placed on calibration decal 14 on crossbar 12 to correspond to the point of contact of the putter shaft to crossbar 12.

Once the shaft has been placed in the close to zero loft position, the golfer identifies the horizontal shaft position on the calibrations of the crossbar. The shaft position will be different for each putter specification, but will always be the same for the individual putter.

The vertical height of the shaft should remain constant to insure stability of the lie angle of the putter. The golfer identifies the vertical shaft position on the crossbar by the calibration decal on the putter shaft.

Figure 6:
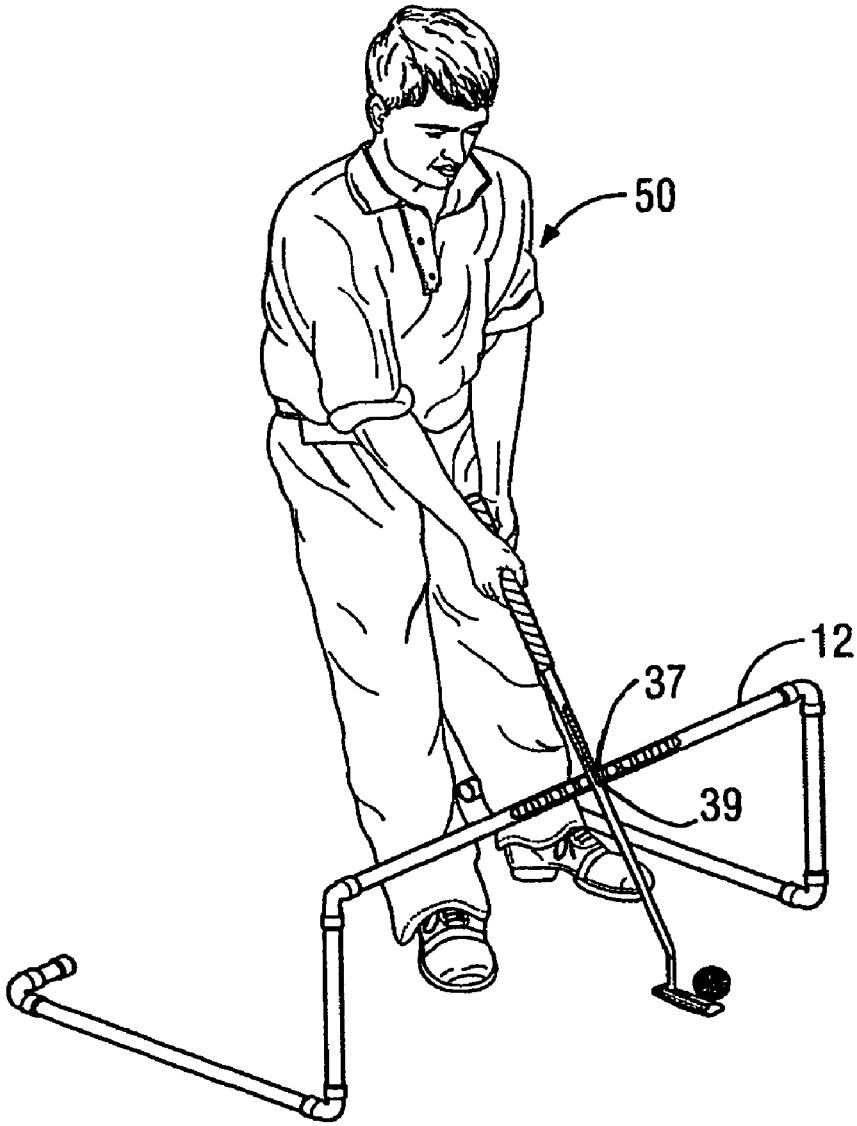
FIG. 6 is a general perspective view of a golfer using the training aid of the present invention to practice his putting stroke.
Figure 7:
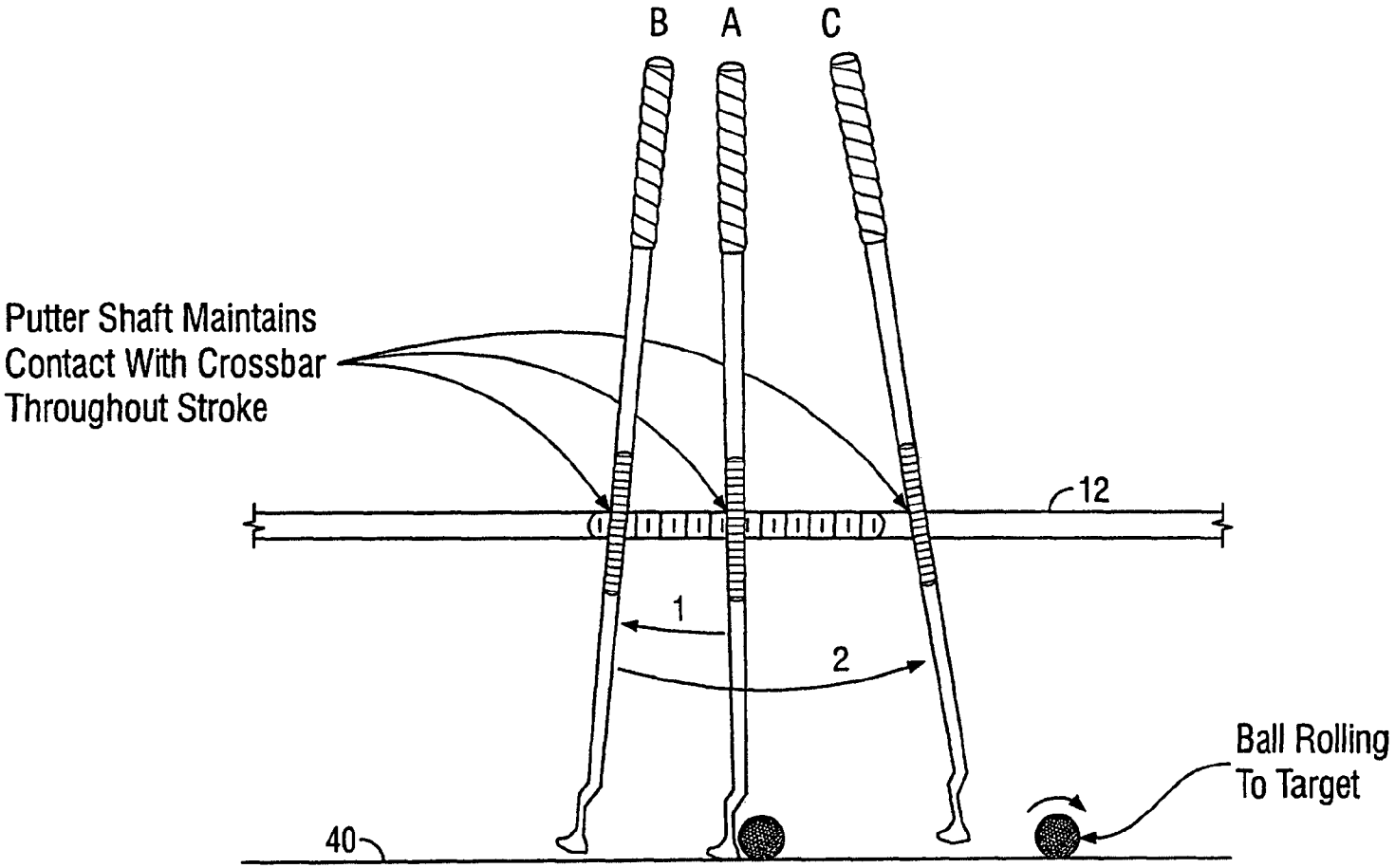
FIG. 7 is a partial front view of the calibration bar of the present invention in practice mode with three positions of the putting stroke shown.

In FIG. 6, A golfer 50 is shown practicing putting with the help of the putting aid embodying the present invention. In this practice mode, the golfer aligns the putter on crossbar 12 with mark 37 on putter shaft scale 30 aligned with mark 39 on crossbar scale 14 and the practice golf ball placed on spot 44. This is the objective, repeatable position determined by the prior calibration procedure so that the putter face is now square to the intended target line which is parallel to the crossbar 12. As shown in FIG. 7, the practice stroke begins at position A in the calibrated putter position as determined by the prior calibration, transitions through back swing 1 to position B, then proceeds through swing arc 2 through initial position A, making contact with the practice ball, to follow through position C. Throughout the stroke, the club shaft maintains contact with crossbar 12 so that the golfer can practice a consistent planar stroke.

After the putter face has been aligned properly in the close to zero loft position, the shaft position on the crossbar can be calibrated.

A square position of the putter face (perpendicular to the crossbar) is key to starting the ball on the desired path. Even with proper usage of the training device, an open or closed putter face will result in a ball rolling right or left of the target line. In order to align the putter face with the device and intended target line it is necessary to make sure that the calibration block is parallel to the crossbar and the intended target line.

While a preferred embodiment of the invention has been disclosed in detail, it should be understood by those skilled in the art that various modifications can be made to the illustrated embodiment without departing from the scope of the invention as described in the specification and hereafter defined in the appended claims.

The invention claimed is:

1. Apparatus for objectively calibrating orientation of a putter to facilitate consistent putting strokes by a golfer, said putter having an axial shaft and a head having a sole and a face, the sole and shaft defining a lie angle and the face having a loft, the apparatus comprising:

a plurality of first position-indicating indicia disposed along the putter shaft;

a plurality of second position-indicating indicia disposed along an elongate axial calibration member supported generally parallel to and spaced above a generally planar putting surface; and said first and second plural position-indicating indicia are positioned and arranged such that placement of the putter shaft against the calibration member with the sole generally flat against the putting surface and with the face oriented with a generally neutral loft causes the first and second indicia to align at a calibration point corresponding to a neutral putter position;

whereby the putter may be consistently re-positioned at the neutral putter position after each putting stroke by placing the putter shaft against the calibration member at the calibration point.

2. The putter-calibrating apparatus of claim 1 further comprising a generally flat loft-calibrating surface generally orthogonal to the putting surface and the calibration member, said loft-calibrating surface being configured and arranged such that the face is positioned flat against the loft-calibrating surface with the loft being generally neutral.

3. The putter-calibrating apparatus of claim 2 further comprising:

a loft-calibrating block including the loft-calibrating surface disposed therealong; and spacer apparatus positioning the loft-calibrating block at a location offset from the calibration member and along the putting surface.

4. The putter-calibrating apparatus of claim 1 further comprising a putter guide surface along the calibration member, said guide surface being positioned and arranged to contact the putter shaft during a putting stroke thereby limiting a range of putter motion and enabling the golfer to repeatedly practice a consistent putting stroke.

5. The putter-calibrating apparatus of claim 4 wherein:

the first plural position-indicating indicia comprise a first linear scale adapted to be affixed to said putter shaft; and the second plural position-indicating indicia comprise a second linear scale disposed along the calibration member.

6. The putter-calibrating apparatus of claim 5 further comprising a substrate having the first linear scale located thereon, said substrate being adapted to be affixed to the putter shaft with the linear scale visible to the golfer.

7. The putter-calibrating apparatus of claim 5 further comprising marking indicia adapted to mark the aligned first and second position-indicating indicia such that the neutral putter position is marked and the putter can be returned to the neutral putter position following a putting stroke.

8. Apparatus for objectively calibrating a putter position to facilitate practice of consistent putting strokes by a golfer, said putter having an axial shaft, a head at a shaft end having a sole and a face, the face having a loft and the sole and shaft defining a lie angle, the apparatus comprising:

first means for demarcating a plurality of positions along the putter shaft;

second means for demarcating a plurality of positions along an axis generally parallel to and spaced above a generally planar putting surface; and said first and second demarcating means being positioned and arranged such that intersection of the shaft and axis with the sole generally flat against the putting surface and the face oriented with a generally neutral loft causes alignment of at least one of each of the first and second demarcating means to objectively calibrate the putter at a repeatable neutral putter position.

9. Apparatus for objectively calibrating orientation of a putter to facilitate consistent putting strokes by a golfer, said putter having an axial shaft and a head having a sole and a face, the sole and shaft defining a lie angle and the face having a loft, the apparatus comprising:

a first position indicator disposed along the putter shaft;

an elongate axial calibration member supported generally parallel to and spaced above a generally planar putting surface;

a second position indicator disposed along the calibration member; and said first and second position indicators being positioned and arranged such that placement of the putter shaft against the calibration member with the sole generally flat against the putting surface and with the face oriented with a generally neutral loft causes the first and second position indicators to align at a calibration point corresponding to a neutral putter position;

whereby the putter may be consistently re-positioned at the neutral putter position after each putting stroke by placing the putter shaft against the calibration member at the calibration point.

10. Apparatus for objectively calibrating a position of a putter having a shaft, a head, a sole and a loft to facilitate consistent putting strokes by a golfer comprising:

a plurality of first position-indicating indicia adapted to be disposed along the putter shaft;

an elongate axial calibration member;

support structure adapted to support the calibration member generally parallel to and spaced above a putting surface; and a plurality of second position-indicating indicia disposed along the calibration member such that the first and second position-indicating indicia may be aligned to identify a putter position in which the loft is generally neutral and the sole is generally flat against the putting surface;

whereby the putter may be consistently returned to the identified putter position after each putting stroke by placing the putter shaft against the calibration member with the indicia in alignment.

11. The apparatus of claim 10 further comprising a loft-calibrating member positioned with respect to the calibration member, the loft-calibrating member being adapted to position the putter such that the loft is generally neutral when the putter head is placed against the loft-calibrating member.

12. The apparatus of claim 11 further comprising:

a face on the putter head, said face defining the loft; and a surface on the loft-calibrating member adapted to be orthogonal to the putting surface such that placement of the face flush against the loft-calibrating member surface positions the putter such that the loft is generally neutral.

13. The apparatus of claim 12 further including spacer apparatus adapted to position the loft-calibrating member with respect to the calibration member.

14. The apparatus of claim 11 further comprising a putter guide surface along the calibration member, said guide surface being positioned and arranged such that the putter shaft contacts the guide surface during a putting stroke thereby limiting a range of putter motion and enabling the golfer to repeatedly practice a consistent putting stroke.

15. The apparatus of claim 14 wherein:

the first plural position-indicating indicia comprise a first linear scale adapted to be affixed to the putter shaft; and the second plural position-indicating indicia comprise a second linear scale associated with the calibration member.

16. The apparatus of claim 15 further comprising a substrate having the first linear scale located thereon, said substrate being adapted to be affixed to the putter shaft.

* * * * *

UNITED STATES PATENT AND TRADEMARK OFFICE

CERTIFICATE OF CORRECTION

PATENT NO. : 7,125,342 B2
APPLICATION NO. : 11/113942
DATED : October 24, 2006
INVENTOR(S) : Port et al.

It is certified that error appears in the above-identified patent and that said Letters Patent is hereby corrected as shown below:

In column 3, line 44, delete “puffing” and insert --putting--.

In column 3, line 45, delete “puffing” and insert --putting--.

Signed and Sealed this

Seventh Day of August, 2007

JON W. DUDAS
*Director of the United States Patent and Trademark Office*